US008336872B2

(12) United States Patent
Liu

(10) Patent No.: US 8,336,872 B2
(45) Date of Patent: Dec. 25, 2012

(54) PAPER FEEDING MODULE AND SCANNING DEVICE USING THE SAME

(75) Inventor: Shi-Ze Liu, Taipei County (TW)

(73) Assignee: Kinpo Electronics, Inc., New Taipei (TW)

( * ) Notice: Subject to any disclaimer, the term of this patent is extended or adjusted under 35 U.S.C. 154(b) by 316 days.

(21) Appl. No.: 12/545,308

(22) Filed: Aug. 21, 2009

(65) Prior Publication Data

US 2011/0018191 A1 Jan. 27, 2011

(30) Foreign Application Priority Data

Jul. 24, 2009 (TW) ..... 98125091 A

(51) Int. Cl.
*B65H 5/00* (2006.01)

(52) U.S. Cl. ..... 271/10.13; 271/114; 271/116

(58) Field of Classification Search ..... 271/10.09, 271/10.11, 10.13, 114, 116
See application file for complete search history.

(56) References Cited

U.S. PATENT DOCUMENTS 5,116,038 A * 5/1992 Kim ..... 271/10.11
5,169,136 A * 12/1992 Yamagata et al. ..... 271/10.13
5,240,239 A * 8/1993 Kim ..... 271/10.11
5,497,986 A 3/1996 Kudo
5,579,129 A * 11/1996 Iwata et al. ..... 358/474
5,678,815 A * 10/1997 Sheng ..... 271/10.13
5,873,441 A * 2/1999 Tsujishita ..... 192/46
6,392,763 B1 * 5/2002 Nishinohara et al. ..... 358/496
7,229,070 B2 * 6/2007 Nakano ..... 271/10.13
7,377,508 B2 * 5/2008 Rhoads et al. ..... 271/116
7,441,763 B2 * 10/2008 Su ..... 271/10.11
7,472,903 B2 * 1/2009 Nakakita et al. ..... 271/114
7,594,650 B2 * 9/2009 Chung et al. ..... 271/116
2002/0101025 A1 * 8/2002 Lee et al. ..... 271/10.11
2003/0184000 A1 * 10/2003 Kim ..... 271/10.11
2005/0263954 A1 * 12/2005 Worley et al. ..... 271/114
2007/0267805 A1 11/2007 Lai et al.
2008/0023903 A1 * 1/2008 Liu et al. ..... 271/10.13
2009/0273137 A1 * 11/2009 Chen et al. ..... 271/121

* cited by examiner

*Primary Examiner* — Prasad Gokhale
(74) *Attorney, Agent, or Firm* — J.C. Patents

(57) ABSTRACT

A paper feeding module including a first shaft, a first ring-shape structure, a paper picking roller and a paper feeding roller is provided. The first shaft has a first stopping block. The first ring-shape structure rotatably covers the first shaft and has a second stopping block and a third stopping block, wherein the first shaft drives the first ring-shape structure to rotate while the second stopping block is pushed by the first stopping block. The paper picking roller rotatably covers the first shaft and is located on the paper feeding path, and has a fourth stopping block, wherein the first ring-shape structure drives the paper picking roller to rotate while the fourth stopping block is pushed by the third stopping block. The paper feeding roller is disposed on the paper feeding path.

8 Claims, 10 Drawing Sheets

PAPER FEEDING MODULE AND SCANNING DEVICE USING THE SAME

CROSS-REFERENCE TO RELATED APPLICATION

This application claims the priority benefit of Taiwan application serial no. 98125091, filed on Jul. 24, 2009. The entirety of the above-mentioned patent application is hereby incorporated by reference herein and made a part of this specification.

BACKGROUND OF THE INVENTION

1. Field of the Invention

The present invention relates to a paper feeding module and a scanning device using the same. More particularly, the present invention relates to a paper feeding module having rollers, and a scanning device using the same.

2. Description of Related Art

Recently, with a booming development of computer technology, and as price of a scanning device goes down due to a strong market competition, the scanning device becomes a popular computer peripheral in the market.

The scanning devices can be grouped into different types according to prices or functions thereof. In detail, the scanning devices are grouped into a handheld scanning device, a paper feeding scanning device, a business card scanning device, a film scanning device, and a platform scanning device, etc. Regarding the paper feeding scanning device, it has a paper picking roller and a paper feeding roller, wherein papers can be sequentially driven by the paper picking roller and the paper feeding roller to move forward to a scanning platform for scanning. However, since a rotating speed of the paper feeding roller is generally faster than that of the paper picking roller, the paper is pulled by the paper feeding roller and the paper picking roller, so that at a moment when the paper is divorced from the paper picking roller, a moving speed thereof is unstable, and accordingly a scanning quality is influenced.

SUMMARY OF THE INVENTION

The present invention is directed to a paper feeding module, which can improve scanning quality of a scanning device.

The present invention is directed to a scanning device, which has a better scanning quality.

The present invention provides a paper feeding module adapted to a scanning device, wherein the scanning device has a paper feeding path. The paper feeding module includes a first shaft, a first ring-shape structure, a paper picking roller and a paper feeding roller. The first shaft has a first stopping block. The first ring-shape structure rotatably covers the first shaft and has a second stopping block and a third stopping block, wherein the first shaft drives the first ring-shape structure to rotate while the second stopping block is pushed by the first stopping block. The paper picking roller rotatably covers the first shaft and is located on the paper feeding path, and has a fourth stopping block, wherein the first ring-shape structure drives the paper picking roller to rotate while the fourth stopping block is pushed by the third stopping block. The paper feeding roller is disposed on the paper feeding path.

The present invention provides a scanning device including a main body, a paper feeding module and a scanning platform. The main body has a paper feeding path. The paper feeding module is disposed in the main body and includes a first shaft, a first ring-shape structure, a paper picking roller and a paper feeding roller. The first shaft has a first stopping block. The first ring-shape structure rotatably covers the first shaft and has a second stopping block and a third stopping block, wherein the first shaft drives the first ring-shape structure to rotate while the second stopping block is pushed by the first stopping block. The paper picking roller rotatably covers the first shaft and is located on the paper feeding path, and has a fourth stopping block, wherein the first ring-shape structure drives the paper picking roller to rotate while the fourth stopping block is pushed by the third stopping block. The paper feeding roller is disposed on the paper feeding path. The scanning platform is disposed on the paper feeding path, wherein the paper feeding roller is located between the paper picking roller and the scanning platform.

In an embodiment of the present invention, the first ring-shape structure includes a first lantern ring and a second lantern ring. The first lantern ring rotatably covers the first shaft and has the second stopping block and a fifth stopping block. The second lantern ring rotatably covers the first shaft and has the third stopping block and a sixth stopping block, wherein the first lantern ring drives the second lantern ring to rotate while the sixth stopping block is pushed by the fifth stopping block.

In an embodiment of the present invention, the paper feeding module further includes a second shaft, a second ring-shape structure and a paper separating roller. The second shaft has a seventh stopping block. The second ring-shape structure rotatably covers the second shaft and has an eighth stopping block and a ninth stopping block, wherein the second shaft drives the second ring-shape structure to rotate while the eighth stopping block is pushed by the seventh stopping block. The paper separating roller is disposed on the paper feeding path and is located between the paper picking roller and the paper feeding roller, and rotatably covers the second shaft, wherein the paper separating roller has a tenth stopping block, and the second ring-shape structure drives the paper separating roller to rotate while the tenth stopping block is pushed by the ninth stopping block.

In an embodiment of the present invention, the second ring-shape structure includes a third lantern ring and a fourth lantern ring. The third lantern ring rotatably covers the second shaft and has the eighth stopping block and an eleventh stopping block. The fourth lantern ring rotatably covers the second shaft and has the ninth stopping block and a twelfth stopping block, wherein the third lantern ring drives the fourth lantern ring to rotate while the twelfth stopping block is pushed by the eleventh stopping block.

In an embodiment of the present invention, the paper feeding module further includes a first gear, a second gear and a gear set. The first gear is fixed to the first shaft. The second gear is fixed to the second shaft. The gear set is coupled between the first gear and the second gear.

In the present invention, the first shaft can drive a paper to move towards the paper feeding roller while the first ring-shape structure drives the paper picking roller to rotate. When the paper simultaneously contacts the paper picking roller and the paper feeding roller, the paper feeding roller with a relatively high rotating speed (compared to that of the first shaft) can dive the fourth stopping block of the paper picking roller to divorce from the third stopping block of the first ring-shape structure through the paper, so that the paper picking roller and the paper feeding roller may have a same tangential speed. Therefore, a problem that the paper is pulled by the paper picking roller and the paper feeding roller due to different tangential speeds of the paper picking roller and the paper feeding roller can be avoided, so that a moving speed of the paper is stable, and accordingly the scanning quality is improved.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
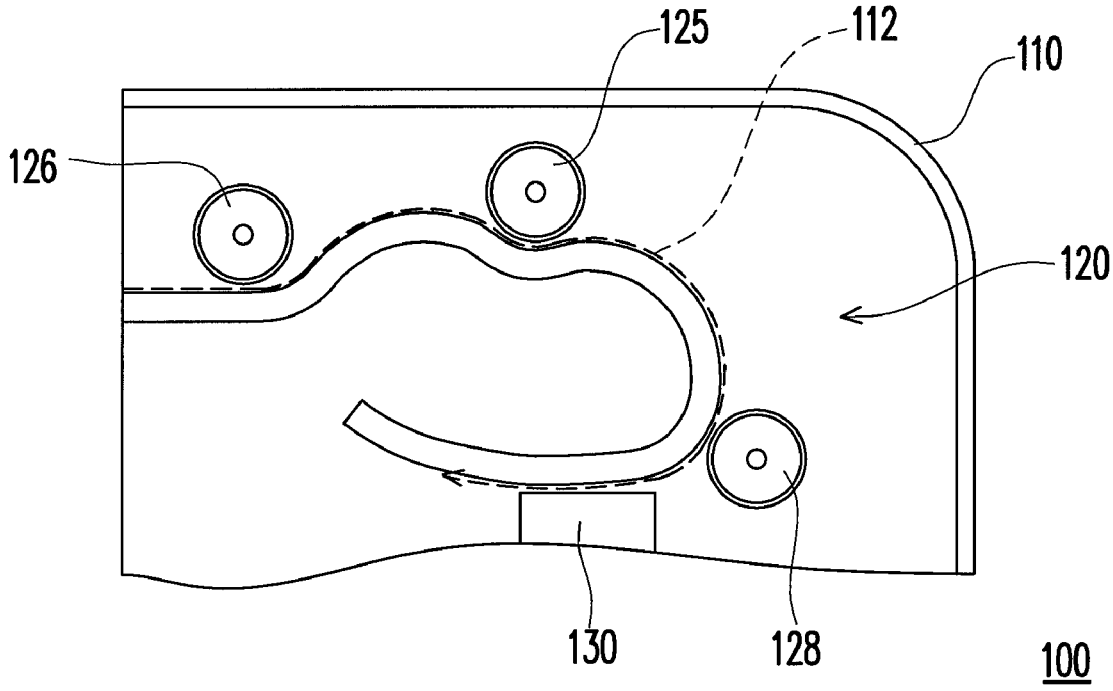
FIG. 1 is a partial structural side view of a scanning device according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
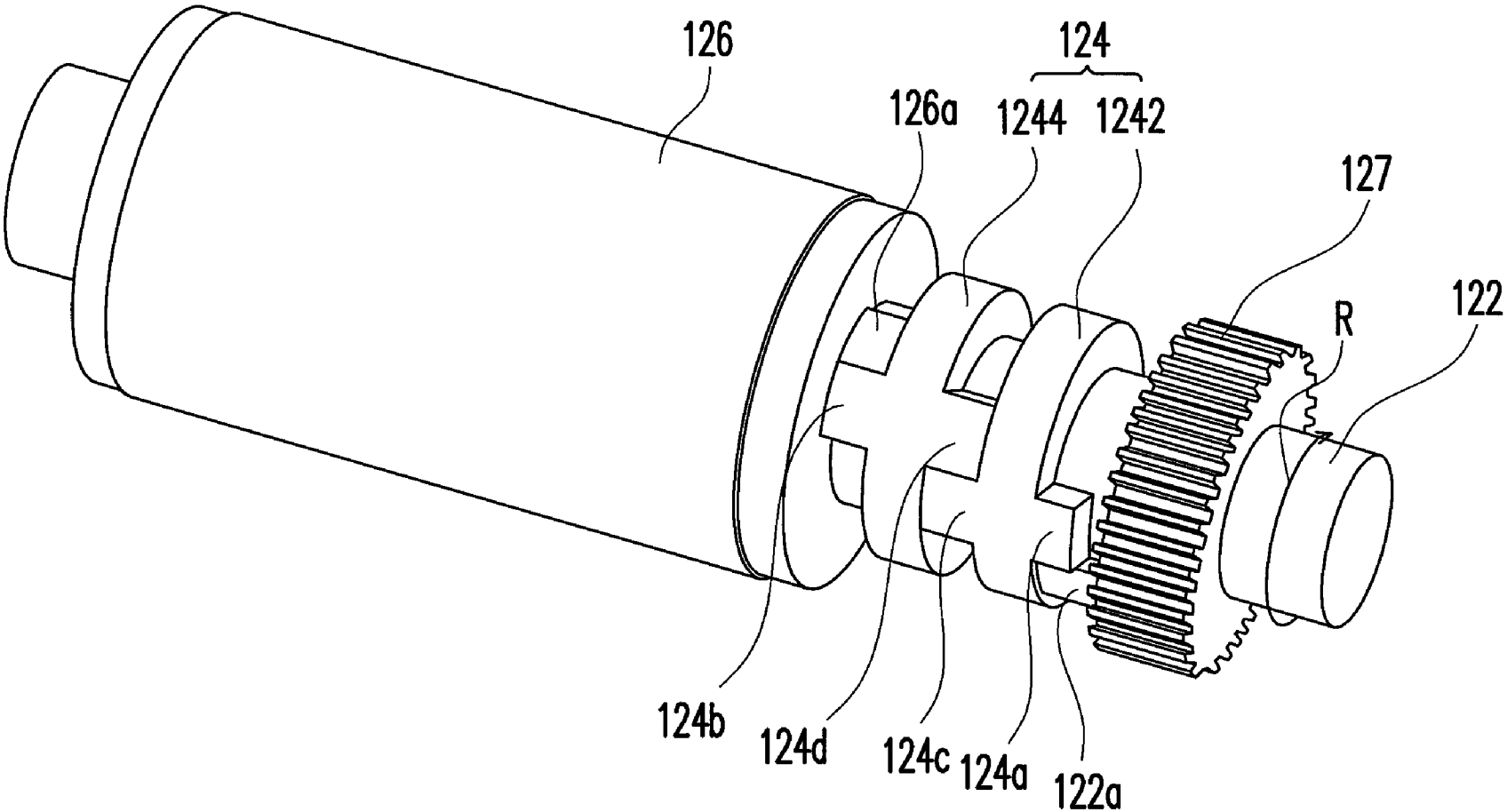
FIG. 2 is a partial three-dimensional view of the paper feeding module of FIG. 1.

FIG. 1 is a partial structural side view of a scanning device according to an embodiment of the present invention. FIG. 2 is a partial three-dimensional view of the paper feeding module of FIG. 1. Referring to FIG. 1 and FIG. 2, the scanning device 100 of the present invention includes a main body 110, a paper feeding module 120 and a scanning platform 130. The main body 110 has a paper feeding path 112. The paper feeding module 120 is disposed in the main body 110 and includes a first shaft 122, a first ring-shape structure 124, a paper picking roller 126 and a paper feeding roller 128.

The first shaft 122 has a first stopping block 122*a*. The first ring-shape structure 124 rotatably covers the first shaft 122 and has a second stopping block 124*a* and a third stopping block 124*b*, wherein the first shaft 122 drives the first ring-shape structure 124 to rotate while the second stopping block 124*a* is pushed by the first stopping block 122*a*. The paper picking roller 126 rotatably covers the first shaft 122 and is located on the paper feeding path 112, and has a fourth stopping block 126*a*, wherein the first ring-shape structure 124 drives the paper picking roller 126 to rotate while the fourth stopping block 126*a* is pushed by the third stopping block 124*b*.

Figure 3A:
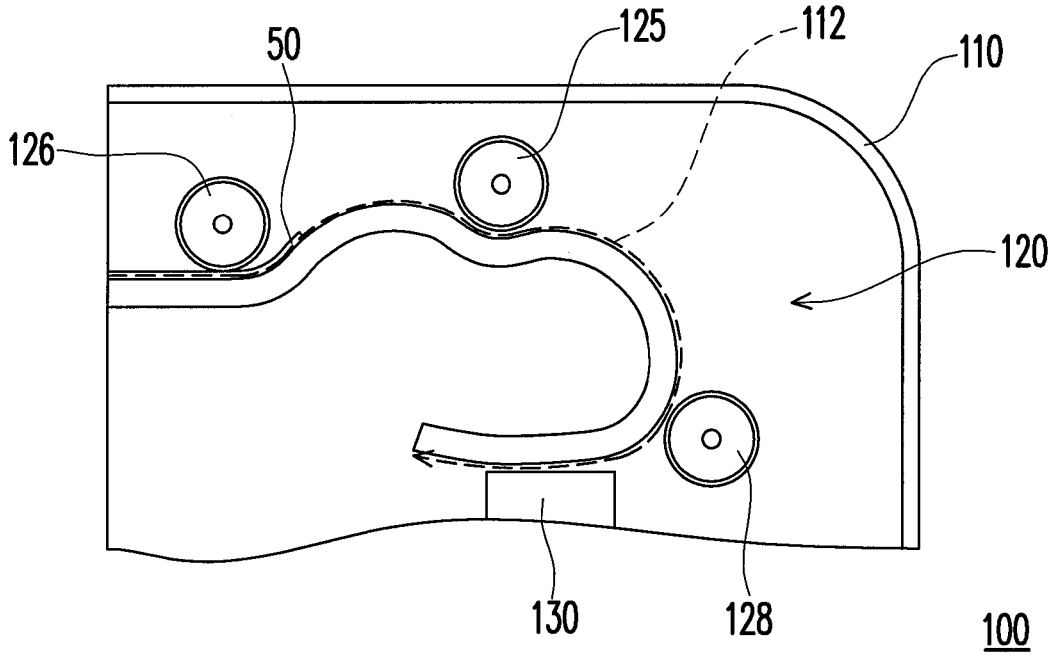
FIGS. 3A-3C are diagrams illustrating an operation flow of the scanning device of FIG. 1.
Figure 3B:
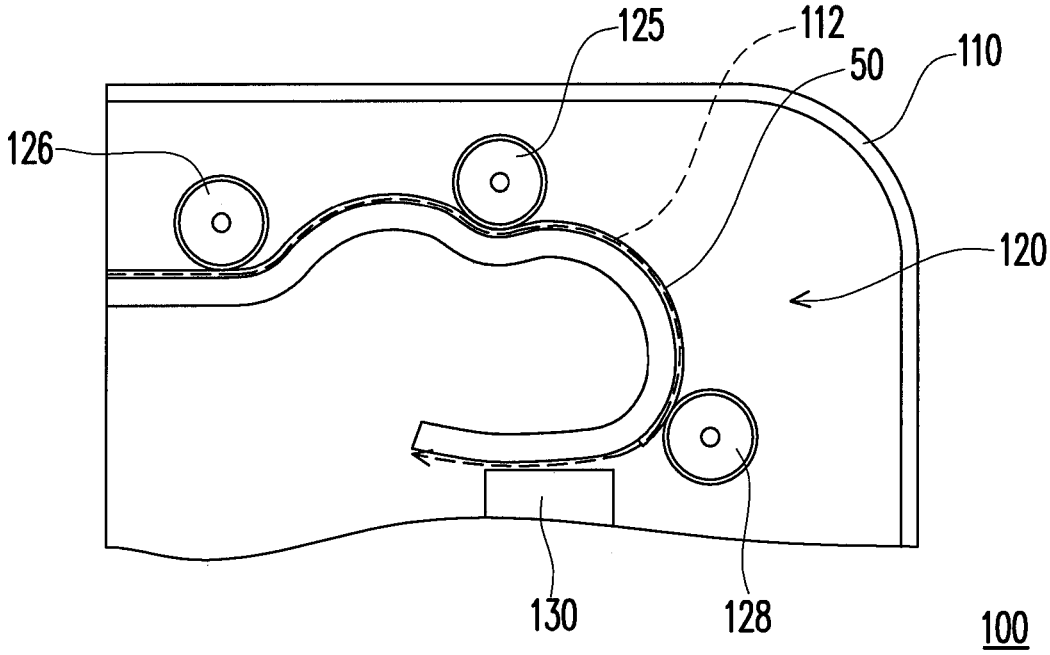
Figure 3C:
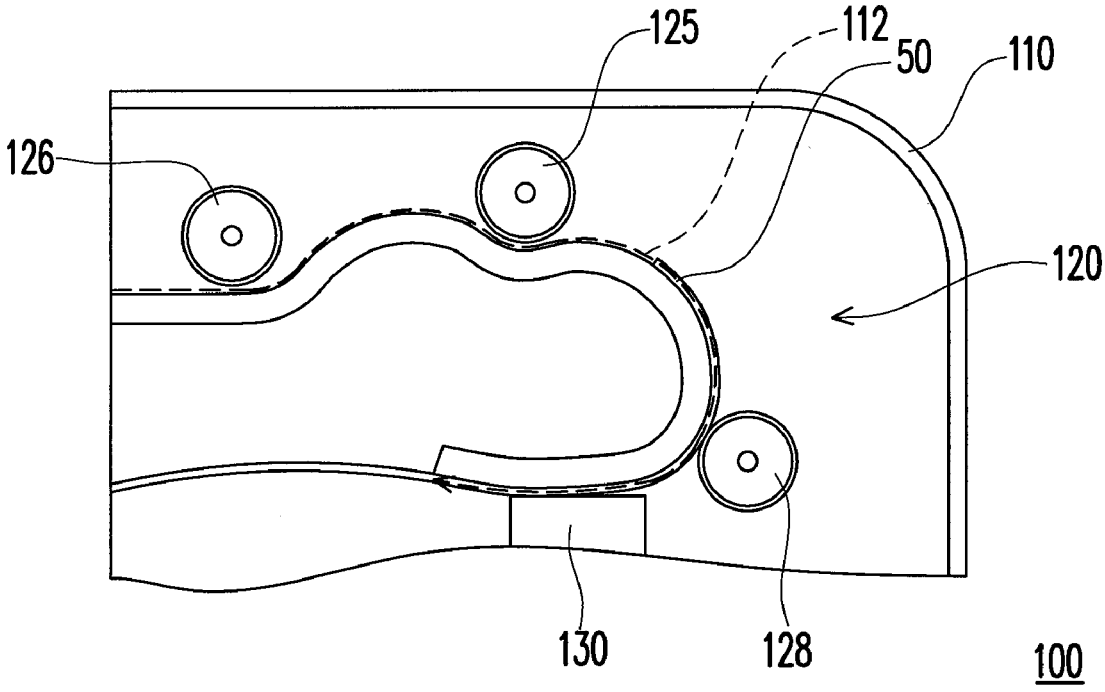

The paper feeding roller 128 is disposed on the paper feeding path 112. The scanning platform 130 is disposed on the paper feeding path 112, wherein the paper feeding roller 128 is located between the paper picking roller 126 and the scanning platform 130. FIGS. 3A-3C are diagrams illustrating an operation flow of the scanning device of FIG. 1. Referring to FIG. 3A, when the scanning device 100 scans a paper 50, the paper picking roller 126 first drives the paper 50 to move along the paper feeding path 112. Referring to FIG. 3B, after the paper 50 is moved to the paper feeding roller 128 along the paper feeding path 112, the paper 50 is driven by the paper feeding roller 128 to move towards the scanning platform 130. Referring to FIG. 3C, after the paper 50 is divorced from the paper picking roller 126, the paper 50 is continually driven by the paper feeding roller 128 to complete follow-up scanning tasks.

It should be noticed that when the scanning device 100 drives the paper 50 to simultaneously contact the paper feeding roller 128 and the paper picking roller 126 (shown in FIG. 3B), the paper feeding roller 128 with a relatively great tangential speed (compared to that of the paper picking roller 126) can drive the fourth stopping block 126*a* of the paper picking roller 126 to divorce from the third stopping block 124*b* of the first ring-shape structure 124 through the paper 50, so that the paper picking roller 126 and the paper feeding roller 128 may have a same tangential speed, and accordingly a problem that the paper 50 is pulled by the paper picking roller 126 and the paper feeding roller 128 due to different tangential speeds of the paper picking roller 126 and the paper feeding roller 128 can be avoided. Therefore, when the scanning device 100 drives the paper 50 to divorce from the paper picking roller 126 (shown in FIG. 3C), a moving speed of the paper 50 can be maintained stable, and accordingly the scanning quality is improved.

Referring to FIG. 2, in detail, the first ring-shape structure 124 includes a first lantern ring 1242 and a second lantern ring 1244. The first lantern ring 1242 rotatably covers the first shaft 122 and has the second stopping block 124*a* and a fifth stopping block 124*c*. The second lantern ring 1244 rotatably covers the first shaft 122 and has the third stopping block 124*b* and a sixth stopping block 124*d*. The first lantern ring 1242 drives the second lantern ring 1244 to rotate while the sixth stopping block 124*d* is pushed by the fifth stopping block 124*c*. Details are described with reference of FIG. 2 and FIGS. 4A-4D.

Figure 4A:
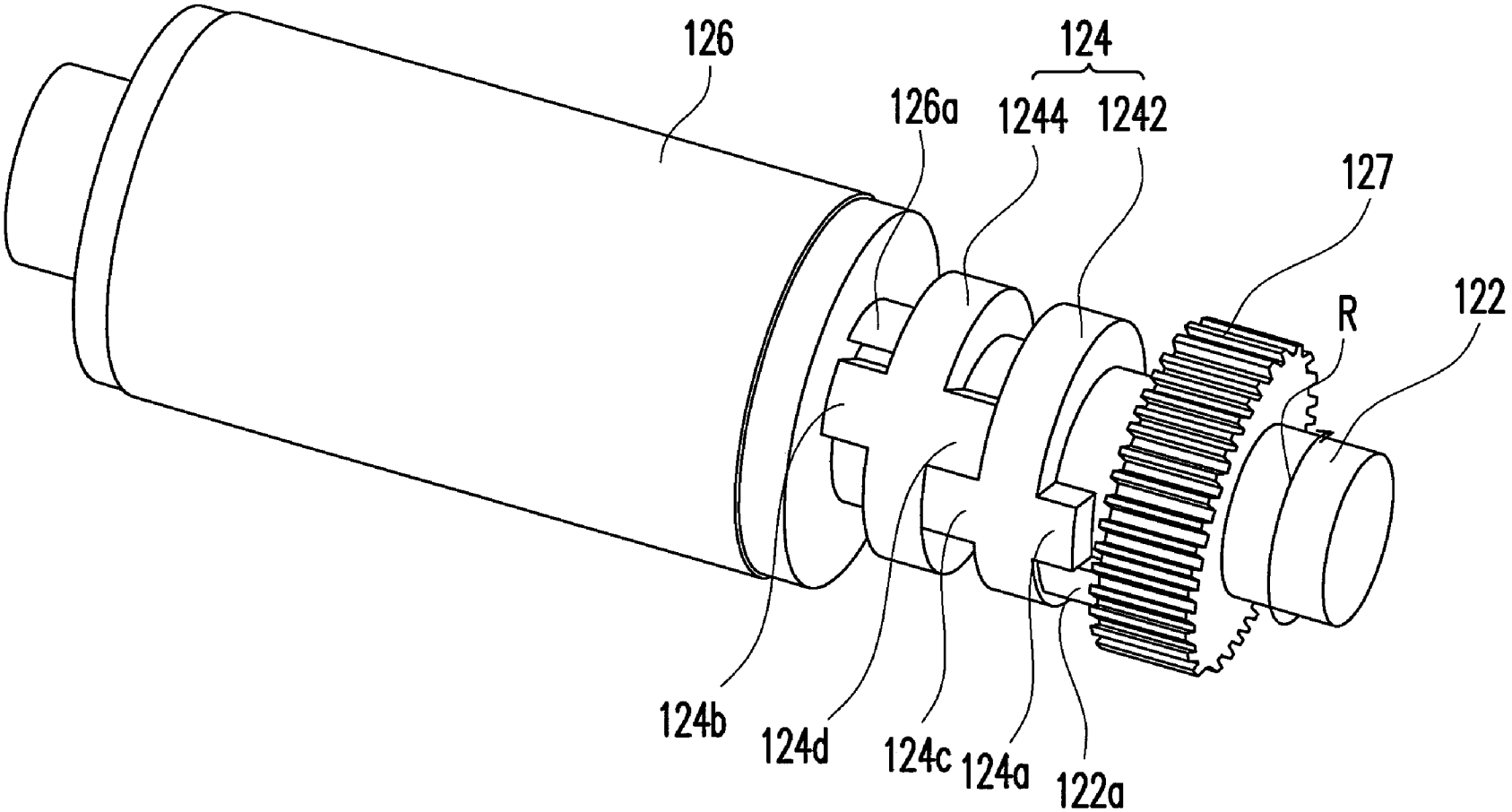
FIGS. 4A-4D are diagrams illustrating a partial operation flow of the paper feeding module of FIG. 1.

FIGS. 4A-4D are diagrams illustrating a partial operation flow of the paper feeding module of FIG. 1. First, referring to FIG. 2, when the first shaft 122 is rotated along a direction R, the first stopping block 122*a* pushes the second stopping block 124*a*, the fifth stopping block 124*c* pushes the sixth stopping block 124*d*, and the third stopping block 124*b* pushes the fourth stopping block 126*a*, so as to drive the paper picking roller 126 to rotate. Referring to FIG. 4A, when the paper feeding roller 128 with the relatively great tangential speed (compared to that of the paper picking roller 126) drives the paper picking roller 126 to rotate along the direction R through the paper 50 (shown in FIGS. 3A-3C), the fourth stopping block 126*a* can be divorced from the third stopping block 124*b* of the second lantern ring 1244, and the paper picking roller 126 and the paper feeding roller 128 can be rotated with a same tangential speed.

Figure 4B:
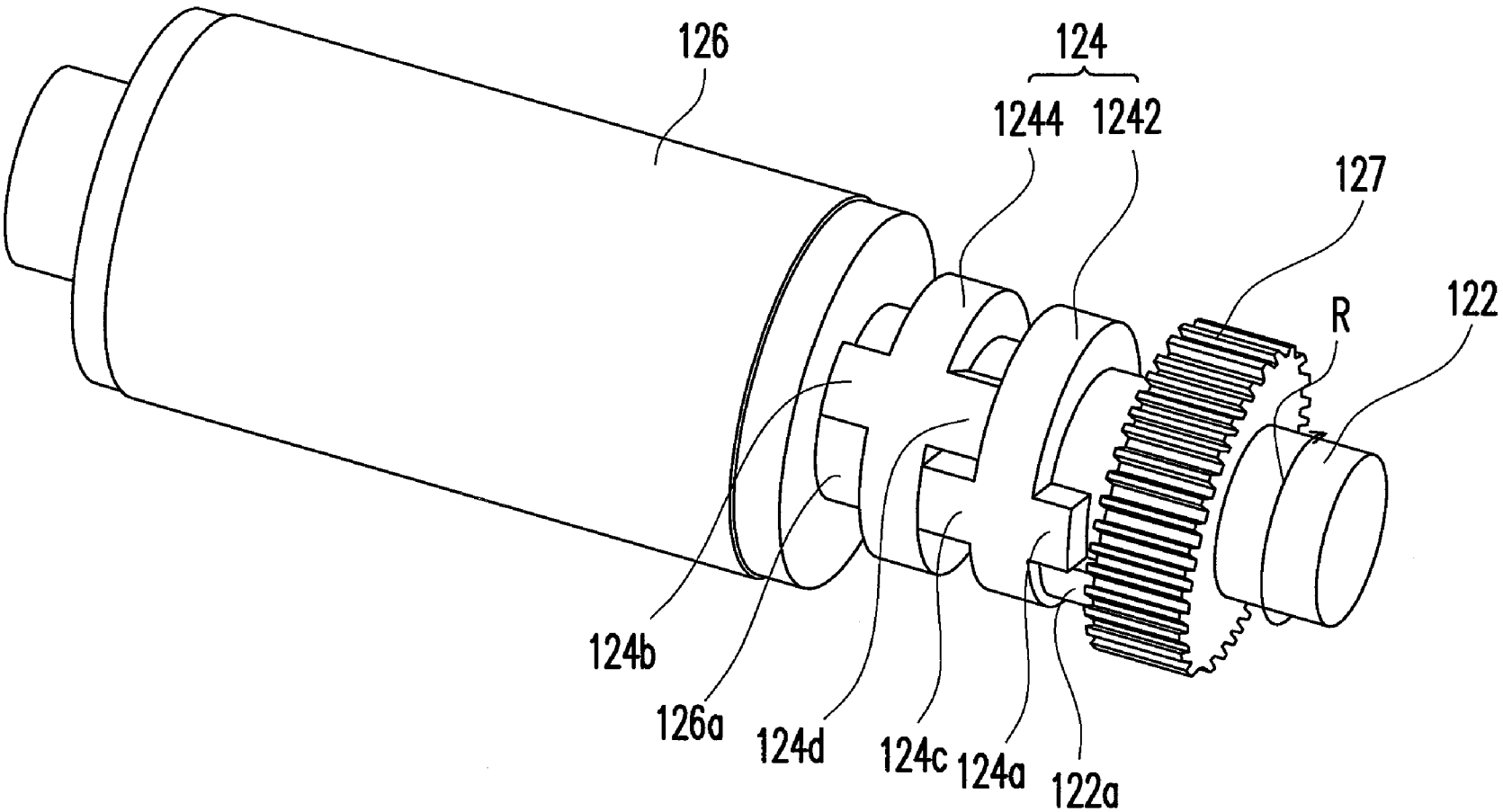
Figure 4C:
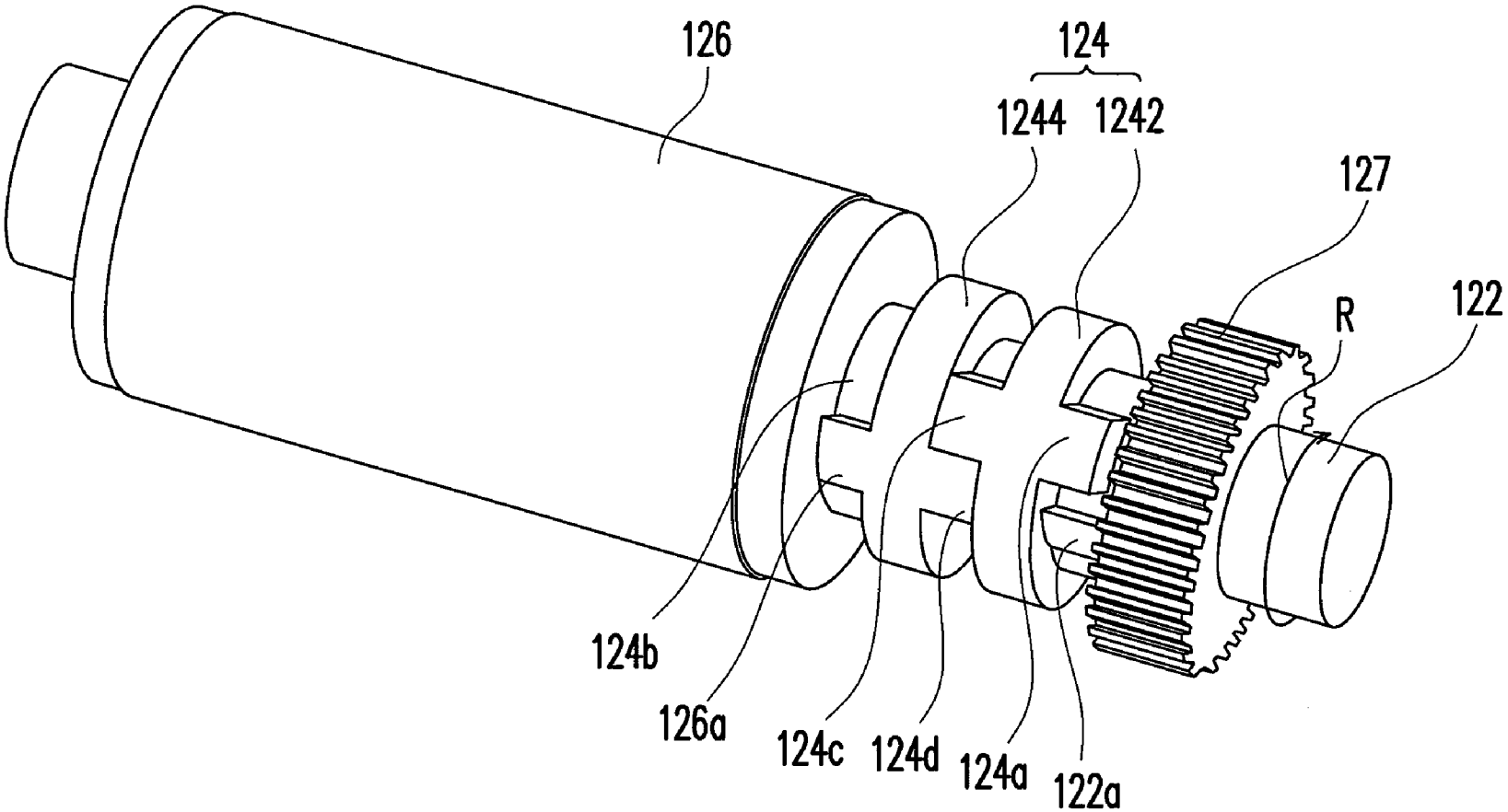

Next, referring to FIG. 4B, since the tangential speed of the paper picking roller 126 is greater than a rotating speed of the first shaft 122 after the paper picking roller 126 is driven by the paper feeding roller 128, the fourth stopping block 126*a* can reach a position shown in FIG. 4B along with the rotation of the paper picking roller 126 to push the third stopping block 124*b*, so that the sixth stopping block 124*d* is driven to be divorced from the fifth stopping block 124*c*, and the paper picking roller 126 and the second lantern ring 1244 are all rotated in a same tangential speed as that of the paper feeding roller 128. Referring to FIG. 4C, the sixth stopping block 124*d* can reach a position shown in FIG. 4C along with the rotation of the second lantern ring 1244 to push the fifth stopping block 124*c*, so that the second stopping block 124*a* is driven to be divorced from the first stopping block 122*a*, and the paper picking roller 126, the first lantern ring 1242 and the second lantern ring 1244 are all rotated in a same tangential speed as that of the paper feeding roller 128.

Figure 4D:
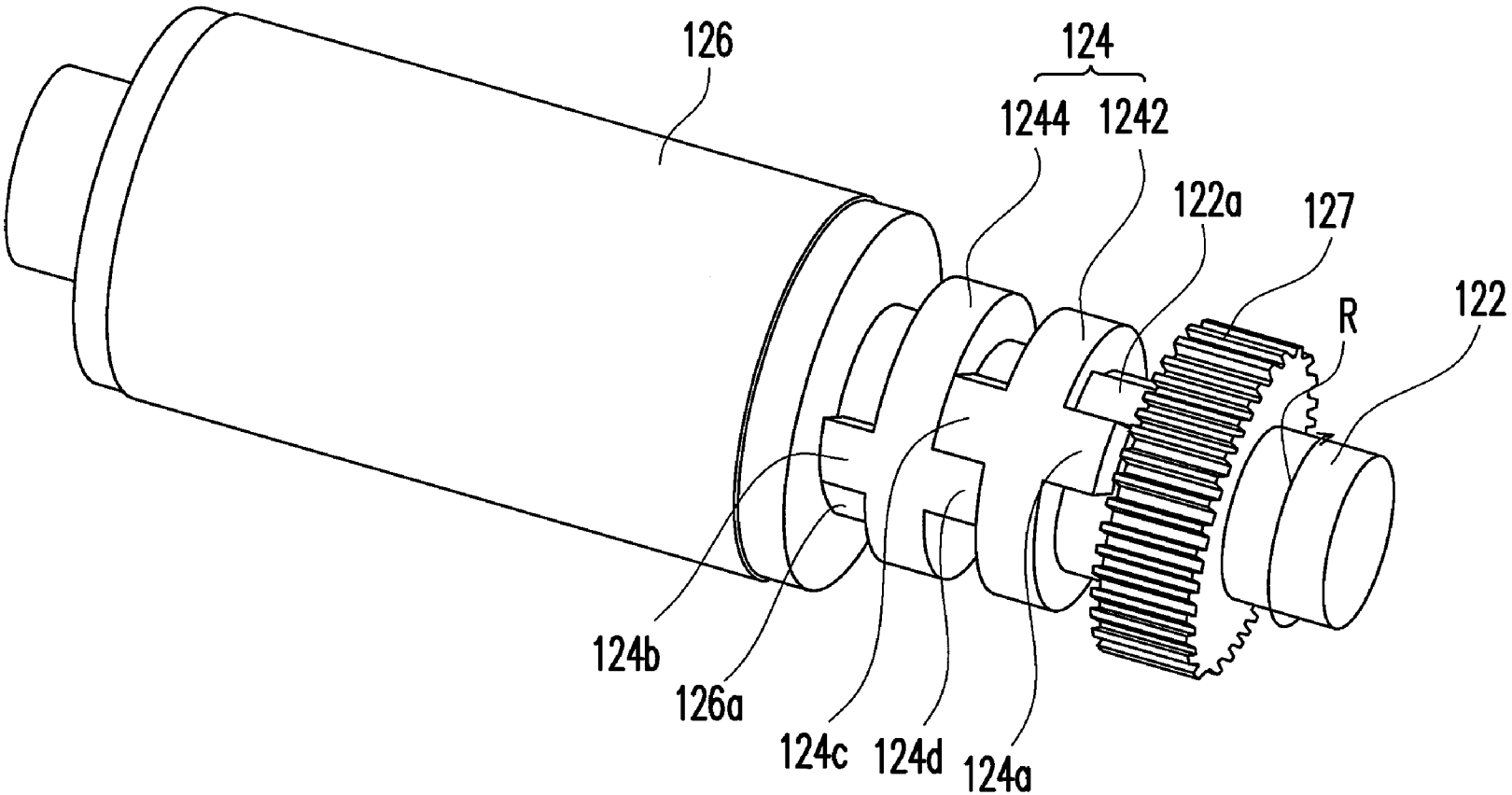

Referring to FIG. 4D, when the paper feeding roller 128 sequentially drives the paper picking roller 126, the first lantern ring 1242 and the second lantern ring 1244 to rotate relatively to the first shaft 122 through the paper 50 to reach a state as that shown in FIG. 4D, since the second stopping block 124*a* again contacts the first stopping block 122*a*, the paper picking roller 126 is limited to be rotated in a rotating speed as that of the first shaft 122 along the direction R. Therefore, a distance between the paper picking roller 126 and the paper feeding roller 128 in the paper feeding module 120 can be determined according to a length of the paper 50 (shown in FIGS. 3A-3C), so that the paper 50 can be divorced from the paper picking roller 126 before the paper feeding module 120 reach a state as that shown in FIG. 4D. After the paper 50 is divorced from the paper picking roller 126, the paper picking roller 126, the first lantern ring 1242 and the second lantern ring 1244 are no longer driven by the paper feeding roller 128, so that the paper feeding module 120 is recovered back to a state as that shown in FIG. 2 along with the rotation of the first shaft 122 for continually feeding another paper (not shown).

During the operation flow shown in FIGS. 4A-4C, the paper picking roller 126, the first lantern ring 1242 and the second lantern ring 1244 are sequentially driven, so that the paper picking roller 126 can be rotated relatively to the first shaft 122 in a same tangential speed as that of the paper feeding roller 128, and a problem that the paper 50 is pulled by the paper picking roller 126 and the paper feeding roller 128 due to different tangential speeds of the paper picking roller 126 and the paper feeding roller 128 can be avoided. It should be noticed that the longer duration for the operation flow shown in FIGS. 4A-4C being maintained, the longer duration for the paper picking roller 126 and the paper feeding roller 128 having the same tangential speed. To achieve such an objective, the first ring-shape structure 124 of the present embodiment is designed to be composed of the first lantern ring 1242 and the second lantern ring 1244, so as to prolong a rotation time of the paper picking roller 126 relative to the first shaft 122.

Figure 5:
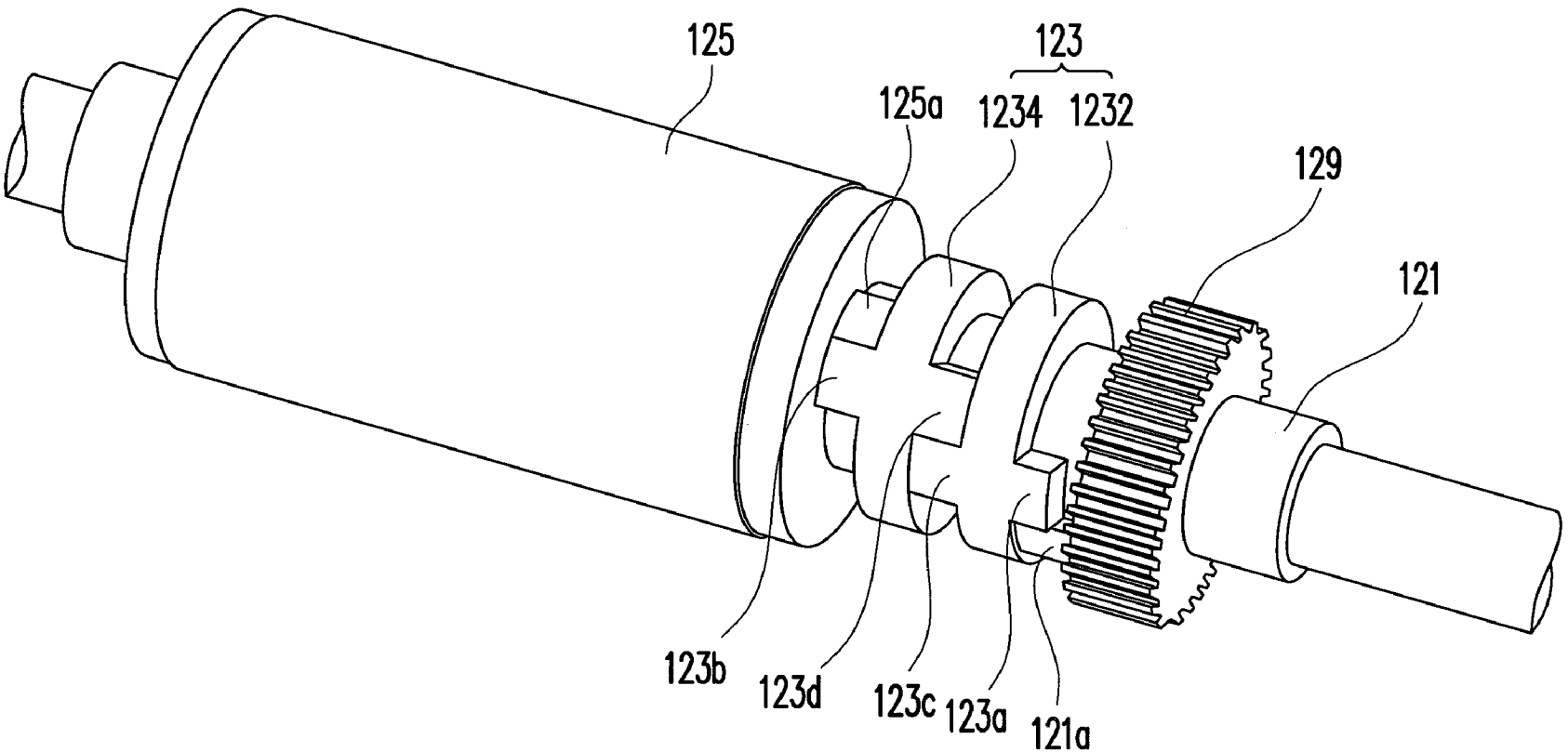
FIG. 5 is a partial three-dimensional view of the paper feeding module of FIG. 1.

FIG. 5 is a partial three-dimensional view of the paper feeding module of FIG. 1. Referring to FIG. 1 and FIG. 5, in the present embodiment, the paper feeding module 120 further includes a second shaft 121, a second ring-shape structure 123 and a paper separating roller 125. The second shaft 121 has a seventh stopping block 121*a*. The second ring-shape structure 123 rotatably covers the second shaft 121 and has an eighth stopping block 123*a* and a ninth stopping block 123*b*. The second shaft 121 drives the second ring-shape structure 123 to rotate while the eighth stopping block 123*a* is pushed by the seventh stopping block 121*a*. The paper separating roller 125 is disposed on the paper feeding path 112 and is located between the paper picking roller 126 and the paper feeding roller 128, and rotatably covers the second shaft 121. The paper separating roller 125 has a tenth stopping block 125*a*, and the second ring-shape structure 123 drives the paper separating roller 125 to rotate while the tenth stopping block 125*a* is pushed by the ninth stopping block 123*b*.

The paper separating roller 125 disposed on the paper feeding path 112 and located between the paper picking roller 126 and the paper feeding roller 128 can separate the papers through friction, so as to ensure the paper 50 fed to the paper feeding roller 128 is a single paper. Moreover, the second ring-shape structure 123 includes a third lantern ring 1232 and a fourth lantern ring 1234. The third lantern ring 1232 rotatably covers the second shaft 121 and has the eighth stopping block 123*a* and an eleventh stopping block 123*c*. The fourth lantern ring 1234 rotatably covers the second shaft 121 and has the ninth stopping block 123*b* and a twelfth stopping block 123*d*. The third lantern ring 1232 drives the fourth lantern ring 1234 to rotate while the twelfth stopping block 123*d* is pushed by the eleventh stopping block 123*c*.

It should be noticed that an operation flow and functions (which are referred to that the paper separating roller 125 can be driven by the paper feeding roller 128 and rotated in the same tangential speed as that of the paper feeding roller 128) of the second shaft 121, the second ring-shape structure 123 (the third lantern ring 1232 and the fourth lantern ring 1234) and the paper separating roller 125 are similar as that of the first shaft 122, the first ring-shape structure 124 (the first lantern ring 1242 and the second lantern ring 1244) and the paper picking roller 126, and therefore detailed descriptions thereof are not repeated.

Figure 6:
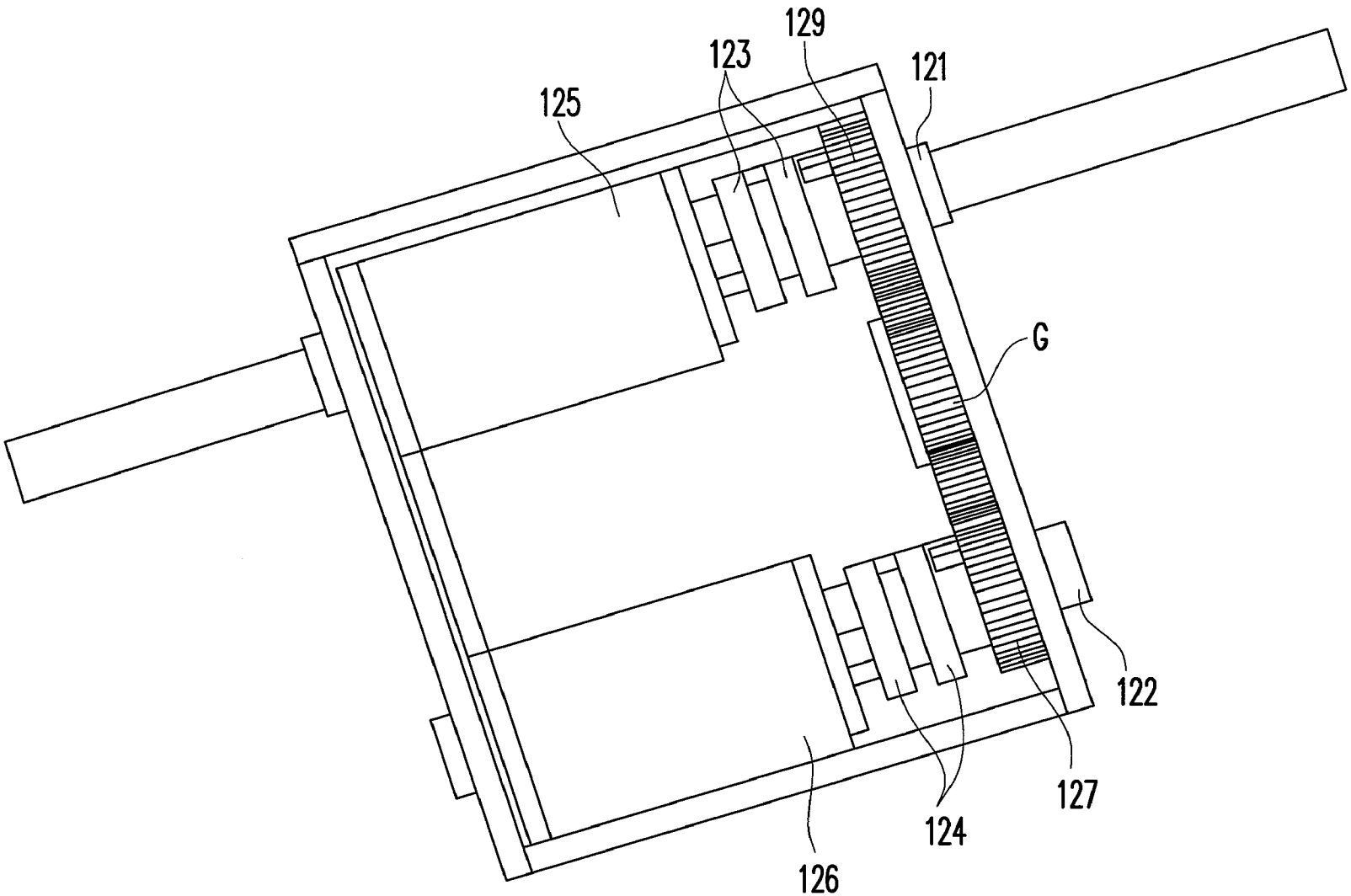
FIG. 6 is a partial three-dimensional view of the paper feeding module of FIG. 1.

FIG. 6 is a partial three-dimensional view of the paper feeding module of FIG. 1. Referring to FIG. 6, in the present embodiment, the paper feeding module 120 further includes a first gear 127, a second gear 129 and a gear set G. The first gear 127 is fixed to the first shaft 122. The second gear 129 is fixed to the second shaft 121. The gear set G is coupled between the first gear 127 and the second gear 129, so that the first shaft 122 and the second shaft 121 can be mutually driven. For example, the first shaft 122 can be coupled to a driving motor (not shown), and the first shaft 122 driven by the driving motor can drive the second shaft 121 to rotate through the first gear 127, the gear set G and the second gear 129. In other words, according to a configuration of the first gear 127, the gear set G and the second gear 129, the driving motor can be commonly used by the paper separating roller 125 and the paper picking roller 126, so as to save a fabrication cost.

In summary, the first shaft can drive a paper to move towards the paper feeding roller while the first ring-shape structure drives the paper picking roller to rotate. When the paper simultaneously contacts the paper picking roller and the paper feeding roller, the paper feeding roller with a relatively high rotating speed (compared to that of the first shaft) can dive the fourth stopping block of the paper picking roller to divorce from the third stopping block of the first ring-shape structure through the paper, so that the paper picking roller and the paper feeding roller may have a same tangential speed. Therefore, a problem that the paper is pulled by the paper picking roller and the paper feeding roller due to different tangential speeds of the paper picking roller and the paper feeding roller can be avoided, so that a moving speed of the paper is stable, and accordingly the scanning quality is improved. Moreover, the first ring-shape structure can be designed to be composed of the first lantern ring and the second lantern ring, so as to prolong a rotation time of the paper picking roller relative to the first shaft, so that the duration for the paper picking roller and the paper feeding roller having the same tangential speed is prolonged.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A paper feeding module, adapted to a scanning device, wherein the scanning device has a paper feeding path for transmitting papers, the paper feeding module comprising:

a first shaft, having a first stopping block;

a first ring-shape structure, rotatably covering the first shaft and having a second stopping block and a third stopping block, wherein the first shaft drives the first ring-shape structure to rotate while the second stopping block is pushed by the first stopping block;

a paper picking roller, rotatably covering the first shaft, being located on the paper feeding path, and having a fourth stopping block, wherein the first ring-shape structure drives the paper picking roller to rotate while the fourth stopping block is pushed by the third stopping block; and a paper feeding roller, disposed on the paper feeding path, wherein when one paper transmitted in the paper feeding path contacts the picking roller and the paper feeding roller simultaneously, the fourth stopping block divorces from the third stopping block along a tangential direction of the first shaft, and the picking roller and the paper feeding roller rotate with a same tangential speed, wherein the first ring-shape structure is suitable for rotating relatively to the first shaft to drive the second stopping block to divorce from the first stopping block, wherein the first ring-shape structure comprises a first lantern ring and a second lantern ring, the first lantern ring rotatably covers the first shaft and has the second stopping block and a fifth stopping block, the second lantern ring rotatably covers the first shaft and has the third stopping block and a sixth stopping block, and the first lantern ring drives the second lantern ring to rotate while the sixth stopping block is pushed by the fifth stopping block.

2. The paper feeding module as claimed in claim 1, further comprising:

a second shaft, having a seventh stopping block;

a second ring-shape structure, rotatably covering the second shaft and having an eighth stopping block and a ninth stopping block, wherein the second shaft drives the second ring-shape structure to rotate while the eighth stopping block is pushed by the seventh stopping block; and a paper separating roller, disposed on the paper feeding path, located between the paper picking roller and the paper feeding roller, and rotatably covering the second shaft, wherein the paper separating roller has a tenth stopping block, and the second ring-shape structure drives the paper separating roller to rotate while the tenth stopping block is pushed by the ninth stopping block.

3. The paper feeding module as claimed in claim 2, wherein the second ring-shape structure comprises:

a third lantern ring, rotatably covering the second shaft and having the eighth stopping block and an eleventh stopping block; and a fourth lantern ring, rotatably covering the second shaft and having the ninth stopping block and a twelfth stopping block, wherein the third lantern ring drives the fourth lantern ring to rotate while the twelfth stopping block is pushed by the eleventh stopping block.

4. The paper feeding module as claimed in claim 2, further comprising:

a first gear, fixed to the first shaft;

a second gear, fixed to the second shaft; and a gear set, coupled between the first gear and the second gear.

5. A scanning device, comprising:

a main body, having a paper feeding path for transmitting papers;

a paper feeding module, disposed in the main body and comprising:

a first shaft, having a first stopping block;

a first ring-shape structure, rotatably covering the first shaft and having a second stopping block and a third stopping block, wherein the first shaft drives the first ring-shape structure to rotate while the second stopping block is pushed by the first stopping block;

a paper picking roller, rotatably covering the first shaft, located on the paper feeding path, and having a fourth stopping block, wherein the first ring-shape structure drives the paper picking roller to rotate while the fourth stopping block is pushed by the third stopping block;

a paper feeding roller, disposed on the paper feeding path; and a scanning platform, disposed on the paper feeding path, wherein the paper feeding roller is located between the paper picking roller and the scanning platform, when one paper transmitted in the paper feeding path contacts the picking roller and the paper feeding roller simultaneously, the fourth stopping block divorces from the third stopping block along a tangential direction of the first shaft, and the picking roller and the paper feeding roller rotate with a same tangential speed, wherein the first ring-shape structure is suitable for rotating relatively to the first shaft to drive the second stopping block to divorce from the first stopping block, wherein the first ring-shape structure comprises a first lantern ring and a second lantern ring, the first lantern ring rotatably covers the first shaft and has the second stopping block and a fifth stopping block, the second lantern ring rotatably covers the first shaft and has the third stopping block and a sixth stopping block, and the first lantern ring drives the second lantern ring to rotate while the sixth stopping block is pushed by the fifth stopping block.

6. The scanning device as claimed in claim 5, wherein the paper feeding module further comprises:

a second shaft, having a seventh stopping block;

a second ring-shape structure, rotatably covering the second shaft and having an eighth stopping block and a ninth stopping block, wherein the second shaft drives the second ring-shape structure to rotate while the eighth stopping block is pushed by the seventh stopping block; and a paper separating roller, disposed on the paper feeding path, located between the paper picking roller and the paper feeding roller, and rotatably covering the second shaft, wherein the paper separating roller has a tenth stopping block, and the second ring-shape structure drives the paper separating roller to rotate while the tenth stopping block is pushed by the ninth stopping block.

7. The scanning device as claimed in claim 6, wherein the second ring-shape structure comprises:

a third lantern ring, rotatably covering the second shaft and having the eighth stopping block and an eleventh stopping block; and a fourth lantern ring, rotatably covering the second shaft and having the ninth stopping block and a twelfth stopping block, wherein the third lantern ring drives the fourth lantern ring to rotate while the twelfth stopping block is pushed by the eleventh stopping block.

8. The scanning device as claimed in claim 6, wherein the paper feeding module further comprises:

a first gear, fixed to the first shaft;

a second gear, fixed to the second shaft; and a gear set, coupled between the first gear and the second gear.

* * * * *